United States Patent [19]

Michel et al.

[11] 4,041,503

[45] Aug. 9, 1977

[54] ATTENDANCE TIME RECORDER

[75] Inventors: Wilfried Michel, Plochingen; Hartmut Reichert; Erich Willmann, both of Esslingen, all of Germany

[73] Assignee: Simplex Time Recorder, Gardner, Mass.

[21] Appl. No.: 730,348

[22] Filed: Oct. 7, 1976

Related U.S. Application Data

[63] Continuation of Ser. No. 556,850, March 10, 1975, abandoned.

[30] Foreign Application Priority Data

Mar. 13, 1974 Germany ..... 2411975

[51] Int. Cl.[2] ..... G07C 1/06

[52] U.S. Cl. ..... 346/83; 346/89; 346/91

[58] Field of Search ..... 346/82, 83, 86, 89, 346/91

[56] References Cited

U.S. PATENT DOCUMENTS

| | | | |
|---|---|---|---|
| 780,012 | 1/1905 | Palmer | 346/86 |
| 1,074,069 | 9/1913 | Sokolov | 346/86 |
| 2,209,409 | 7/1940 | Long | 346/86 |
| 3,838,430 | 7/1974 | Digney | 346/144 X |

*Primary Examiner*—Joseph W. Hartary
*Attorney, Agent, or Firm*—Neuman, Williams, Anderson & Olson

[57] ABSTRACT

The present invention relates to an attendance time recorder having a printing device for printing times on a data medium such as a time card. The arrangement includes a printing head adapted to support printing types and a plurality of adjacently disposed number wheels of annular form with internal teeth for indexing by engagement with an indexing pawl and retaining means for the data medium. The retaining means and the printing head are adjustable according to a program and a drive is provided for effecting linear sliding movement of the printing head relative to the retaining means.

15 Claims, 11 Drawing Figures

32
30
28
26
2
24
14
148
144
150
A
146
152
153
10
34
20
101
46
58
22
62
16
60
18
44
38
100
42
40
84
90
94
82
36
102
88
74
80
82a
12
76
92
78
86
108
110
72
96
2

ATTENDANCE TIME RECORDER

This is a continuation of application Ser. No. 556,850 filed Mar. 10, 1975, now abandoned.

The invention relates to an attendance time recorder with a printing device for printing clock times on a data medium such as a time card.

The time cards of known time recording clocks of the kind described above are inserted into a so-called card slide which guides the time card while the latter is inserted into the time recording clock and positions the said card during the printing operation. The card slide of known time recording clocks is slidable in the transverse direction, i.e. in the line direction, so that data, i.e. as a rule clock times, can be stamped in sequence into the lines of the time card. This system not only suffers from the disadvantage that time recording clocks with a transverse card slide must be at least twice as wide as the time recording card, but also gives rise to problems in constructing the casing of such a time recording clock in relatively tightly sealed form unless it is made even broader than dictated by the sliding travel of the card slide.

The invention was based on the problem of constructing an attendance time recorder in the most compact possible form and the present invention solves this problem by providing an attendance time recorder having a printing device for printing clock times on a data medium such as a time card, comprising a printing head adapted to support printing types and having a plurality of adjacently disposed number wheels of annular form with internal teeth for indexing by engagement with an indexing pawl and retaining means for the data medium, said retaining means and the printing head being adjustable in accordance with a programme and a drive is provided for effecting linear sliding movement of the printing head relative to the retaining means.

Since the printing head is slidable, it is not necessary for the card slide or in general terms for the retaining means for the data medium to be displaced in the line direction so that the width of a time recorder according to the invention can be theoretically reduced close to the width of the data medium. Furthermore, the opening through which the data medium is inserted into the apparatus or the opening in the apparatus casing for the retaining means of the data meaning need only be made as broad as the data medium itself or its retaining means. Finally, the design is simplified compared with that of known apparatus in a further aspect: the time card in known time recording clocks is inserted to different depths into the card slide in dependence on the day of the week and the final position of the time card for the printing operation is defined by a locking device. The said locking device of transversely slidable card slides must either co-execute such movement or be constructed so that it is able to act independently on the card slide irrespective of the transverse position thereof. In an attendance time recorder according to the invention the locking device can be simply constructed and can be mounted so as to be fixed with respect to the apparatus. This also applies to devices to prevent overstamping, i.e. devices which prevent printing in a line which has already been printed.

By analogies to typewriters with a transversely slidable carriage and a stationary printing device on the one hand as well as by analogy to typewriters with a stationary paper guide and transversely slidable printing on the other hand it could be argued that it was obvious to adapt the printing head instead of the retaining device for the data medium for transverse sliding; however, this would overlook the fact that it is only the inventive construction of the printing head which enables the latter to be made transversely slidable by using a design whose complexity could still be tolerated: printing heads of known time recording clocks occupy a relatively large amount of volume and have a large mass which is due to the fact that one side of their number wheel of a type disc, the circumference of which supports the printing types, is provided with a gear rim and the other side is provided with a sliding block which allows the indexing pawl to drop into the gear ring of the adjacent number wheel with the higher digit value only if two number wheels are to be simultaneously indexed. The number wheel width resulting from this requirement leads to substantial transverse dimensions of the printing heads of known time recording clocks and since the gear rim and sliding block of a number wheel have approximately the same width as the type disc thereof it follows that the width of known number wheels is at least approximately equal to three times the width of the printing types. The width and mass of the printing head can be substantially reduced according to the invention by virtue of tooth systems and sliding blocks of the number wheels having been re-sited in the interior of the said annular elements. In this context it should also be mentioned that the printing head of a time recording clock cannot be compared with the printing device of a typewriter because the printing head is required always to print several symbols simultaneously while the printing device of a typewriter always prints one symbol in each printing operation; the printing heads of time recording clocks are therefore much more complicated and heavy than the ball printing head of a known typewriter with stationary paper retaining means, a fact which evidently discouraged the experts from adopting the printing head instead of the card slide of a time clock for sliding.

Reference to copending Michel et al U.S. application Ser. No. 556,860 filed Mar. 10, 1975 and entitled Printing Device For Printing Multi-Digit Numbers, More Particularly For Attendance Time Recorders should be made as regards the details of the number wheels and the mode of their indexing in a printing head according to the invention. It is not advisable to obtain the sliding motion of the printing head in the line direction by means of a rack and an indexing pawl because of the frequently substantial sliding travels traversed by the printing head in the line direction and because of the different magnitude of the sliding steps. A construction in which the drive is provided with an electric motor which can be switched on and off at the beginning and approximately at the end of each sliding motion of the printing head, a positioning device for the printing head in order to retain this in the specified position along a line, and a resilient coupling between the electric motor and printing head is preferred. To this end the resilient coupling in conjunction with the positioning device is provided to eliminate the detrimental effects of the run-out travel of the electric motor and of a transmission which may be connected downstream thereof. Conveniently, the electric motor is controlled by means of the programme control system which is in any case provided in the attendance time recorder.

In a preferred embodiment of the invention the printing head is coupled to a rack adapted to mesh with a toothed disc which can be driven by the electric motor and has a tooth-free zone situated opposite the rack at the end of the lines; the printing head is also biased by the action of a restoring spring. In this way relatively simple design means are sufficient to ensure that the printing head is automatically returned at the end of each line.

It might be conceivable to utilize the rack as part of the previously-mentioned positioning device, for example by arranging for a ratchet element to drop between the teeth of the rack in the specified positions of the printing head. However, in order not to complicate the return motion of the printing head it is more appropriate to separate the positioning function from the rack. Appropriate details are disclosed in the attached Claims and the description of a preferred embodiment.

The time card of known time recording clocks is situated between the stationary printing head and a striker which strikes the time card against the printing head in order to print a clock time. Since the printing head is in any case movable in the construction according to the invention, it is possible to dispense with a movable striker by virtue of the fact that the printing head can be moved for printing in the direction towards the data medium. This can be achieved most simply by arranging the printing head to pivot about an axis extending in the line direction and in the preferred embodiment of the invention this axis was sited in the means for guiding the transverse sliding motion of the printing head: to this end the printing head is longitudinally slidable on a bar and is supported thereon so as to be pivotable about the said bar.

To prevent the tilting motion of the printing head being obstructed by its drive it is advisable to mount the previously-mentioned rack on a carriage which is slidably guided in the line direction and is adapted to entrain the printing head by means of a stop abutment. The stop abutment can be constructed so that it does not obstruct the tilting motions of the printing head.

A rod which extends in the line direction and is adjustable transversely thereto is provided for pivoting the printing head in the preferred embodiment of the attendance time recorder according to the invention in order to avoid the need for transverse displacement of an actuating device for pivoting the printing head, for example, an electromagnet, together with the printing head, a feature which is fundamentally possible, but while ensuring on the other hand that the printing operation can be triggered in any desired position of the printing head; other operating elements can be used, for example a rod which extends in the line direction and is rotatable for printing and having disposed thereon a cam which is slidable together with the printing head.

It is desirable to effect so-called real time recording in order to obtain the actual attendance time of a worker simply by subtraction of two numbers. To this end it is known for the time recording clock not to print the actual clock time but to print a time which varies during the work intervals despite the progressive working time. This will be explained subsequently in detail in connection with the description of the preferred embodiment. In one attendance time recorder whose printing head is provided in known manner with an indexing lever for indexing the printing type carrier such real time stamping can be obtained most simply by operating the indexing lever directly or indirectly through at least one switch arm which is mounted on a shaft, the said switch arm being slidable along the longitudinal extension of the shaft, more particularly together therewith. Displacement of the switch arm enables this to be moved into and out of engagement. The shaft will be appropriately driven by a stepping motor which is provided with pulses from a master clock and then rotates the switch arm shaft through a specified angle, for example 60°. A construction of this kind also offers the advantage that the number of switch arms mounted on the switch arm shaft enables the manner of displaying the printed clock times to be easily varied as will also subsequently be explained in detail in the description of the preferred embodiment. The indexing transmission comprising the indexing lever and the switch arm or the switch arms of the switch arm shaft enables the stepping motor to be replaced by a continuously rotating motor, more particularly an electric synchronous motor. The switch arm or switch arms are moved along the longitudinal extension of the switch arm shaft in dependence on the programme control of the attendance time recorder in which the earliest work starting time and work intervals are stored.

A simple construction, which can be controlled by pulses, for displacing the switch arm shaft in dependence on the programme control system is provided by a disc cam which can be indexed in steps through half the cam pitch and against which a tracing element bears resiliently, said tracing element being adapted to slide the switch arm shaft to and fro. The resilient contact of the tracing element enables the switch arm shaft to be displaced along its longitudinal extension even when it is in the process of being rotated, i.e. the state of the printing device regarding the real time recording can be altered even if the printing head is in the process of being indexed. This is not possible in known constructions with real time recording because such devices call for rigid disengagement and engagement of meshing gearwheels.

To enable the printing head to be indexed in any desired position it is appropriate to provide a control rod which co-operates with the indexing lever of the printing head, extends in the line direction and can be actuated by the switch arm.

As already mentioned, known time recording clocks are provided with a striker which is mounted on the rear wall of apparatus casing and is adapted to strike the time card against the printing head. The said rear wall also supports an indexing device for a stop abutment which is adjustable in the column direction of the data medium and on which the bottom edge of the time card bears. Depending on the arrangement of the time card, i.e. depending on its subdivision, the time recording clock will have to contain a differently constructed indexing device — for example, if the columns of the time card are associated with the IN or OUT times and the lines are associated with the days it will be necessary for the indexing device to be controlled by the programme control system of the time recording clock in order to adjust the stop abutment on each day by one line; however, if the columns of the time card are associated with the days of the week so that the IN and OUT times are stamped one below the other in the columns, it is advisable to provide the indexing device with an optical scanning system which scans the time card for the last printed impression in a column whereupon the indexing device defines the new position of the stop abutment accordingly. It is therefore necessary to manufacture or keep in stock as many variations of known time recording clocks as there are time cards with different divisions.

The invention enables this disadvantage to be avoided. If not only the indexing device for a stop abutment which is slidable in the column direction of the data medium is mounted on the rear wall of the apparatus housing for the said data medium but also the retaining means thereof and if furthermore the stop abutment is guided along the rear wall and the latter is interchangeable, it is possible for the attendance time recorder according to the invention to be easily adapted to a differently organized data medium simply by exchanging the rear wall of the apparatus. Numerous considerations militated against the idea of making the apparatus rear wall interchangeable in known time recording clocks: on the one hand, it would have been hardly possible to construct an interchangeable rear wall in view of the striker and drive which strikes the time card from the rear against the printing head, and on the other hand the drive for the transversely slidable card slide — the retaining means for the data medium — in known time recording clocks is disposed in the interior apparatus and must be in active co-operation with the card slide so that it would have been impossible to obtain, with a tolerable degree of expenditure and effort, an interchangeable apparatus rear wall adapted to support the card slide. It is only the principal idea of the present invention, namely to slide the printing head in the line direction, which makes it possible to dispense with a slidable card slide, thus opening the way to obtaining an interchangeable unit which comprises all elements required for positioning the data medium in the correct line.

Figure 1:
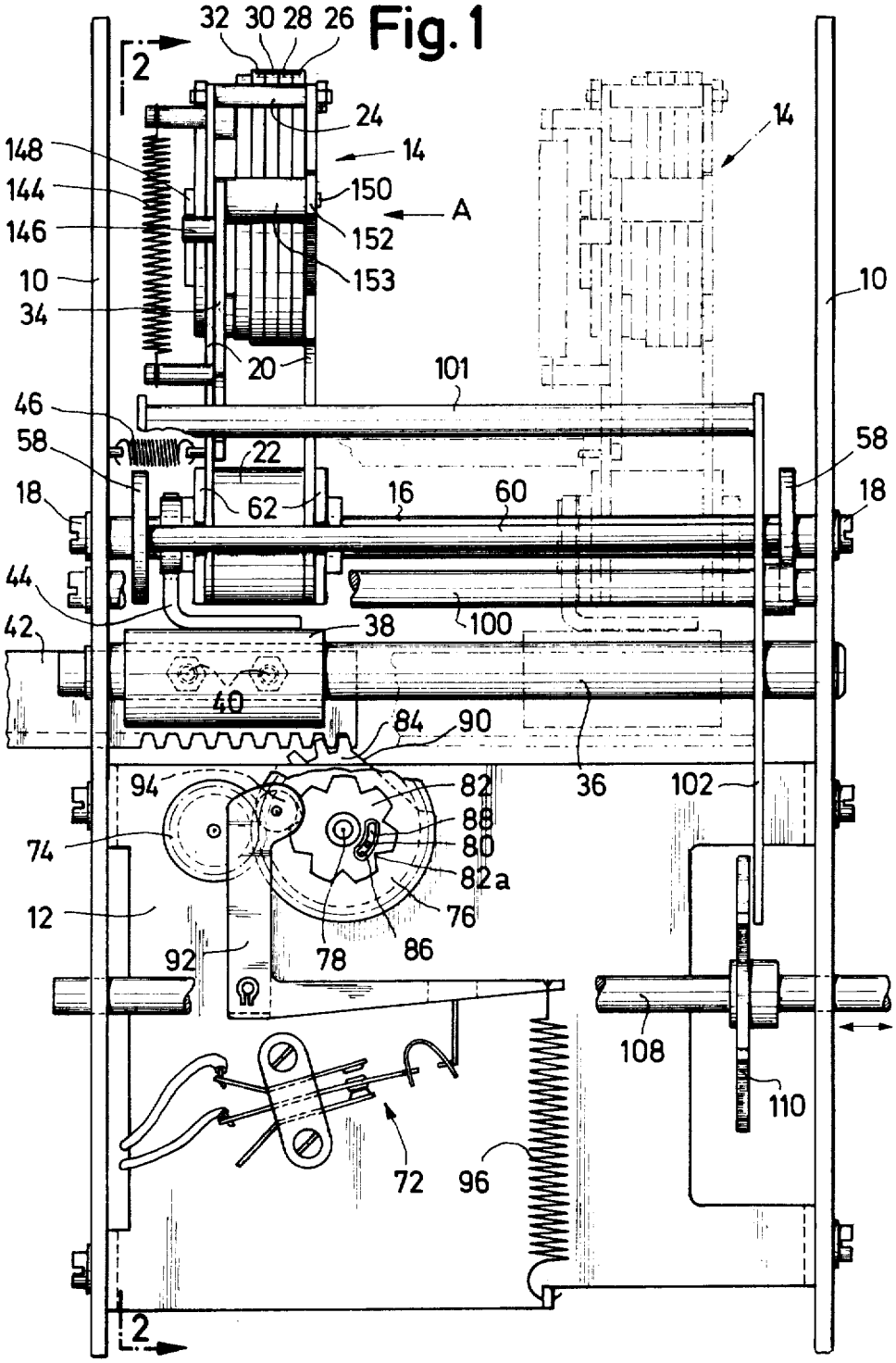
FIG. 1 is a front view of the main components of a time recording clock according to the present invention.
Figure 2:
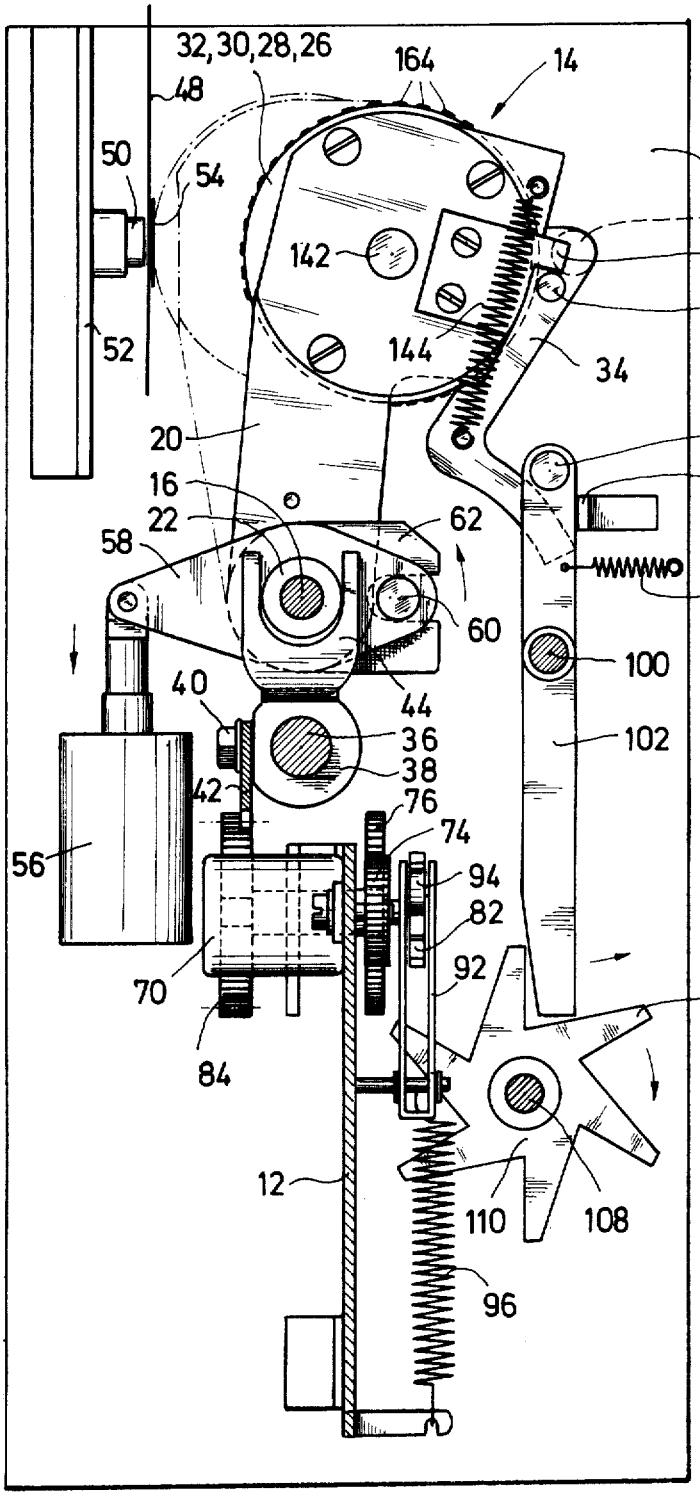
FIG. 2 is a section taken along the line 2—2 of FIG. 1.

FIGS. 1 and 2 disclose two side walls 10 and a transverse wall 12 adjoining said side walls in the framework of the time recording clock according to the invention; the side walls are also joined to each other by different rods reference to which will be made subsequently. A printing head, referenced in its entirety by the numeral 14, can be slid along a guide rod 16 and is pivotable about the said guide rod; the guide rod is mounted by means of screw fasteners 18 between the side walls 10. The printing head substantially comprises two side members 20 which are retained together at a distance from each other by means of a plastics bush 22, adapted to slide on the guide rod, and by means of a plurality of spacer posts 24. Four number wheels 26 to 32 are rotatably supported between the side members in a manner which will be described subsequently and the said number wheels are indexed by means of an indexing lever 34 which is pivotable about the centre of the number wheels.

A further rod 36 is mounted below the guide rod 16 between the side members 10; a bush 38 on which a rack 42 is mounted by means of screw fasteners 40 slides on the afore-mentioned rod 36. The bush also supports a driver bar 44 which surrounds the guide rod 16 from below in the manner of a clevis and bears against the printing head 14 under the action of a return spring 46 one end of which acts on one side wall 10 and the other end on one side wall 20.

The actual printing operation will be briefly explained before describing the horizontal travel of the printing head 14 along the lines of a time card indicated at 48 in FIG. 2. A fixedly mounted rubber strip 50, attached to a plate 52, is situated according to the invention at the level of the printing head behind the time card 48. An inking ribbon 54 extends between the time card and the printing head. To print a clock time the printing head 14 is pivoted towards the time card 48 (dash dot position of FIG. 2) from the position illustrated in solid lines in FIGS. 1 and 2, namely by a printing magnet 56 which is fixedly mounted, according to the invention, on the frame, and acts on one of two pivoting plates 58 which are pivotable about the guide rod 16. The said pivoting plates are rigidly joined by means of a rod 60 which engages in two driver clevises 62 which are mounted on the side members of the printing head by means of screw fasteners 64 shown in FIG. 4. When the printing magnet 56 is energized (see arrow in FIG. 2), the printing head will be pivoted anticlockwise by the bar 60 according to FIG. 2 irrespective of the position at which the guide rod 16 is situated at that time. On completion of the pulse applied to the printing magnet 56 the latter as well as the pivoting plates 58 and the printing head 14 return into the starting position (shown in solid lines) under the action of a spring which is not shown.

A servomotor 70 which is started by a current pulse from the control system is provided to enable a programme control system, not shown, to move the printing head 14 along the guide rod 16 and therefore along the lines of the time card 48 in pre-defined steps (for example the column spacing of the time card). The said motor will then operate until a switch 72 shown in FIG. 1 interrups a circuit of the servomotor (FIG. 1 shows the switch 72 in this position). A driving pinion 74 of the servomotor 70 meshes with a gearwheel 76 which is rotatably supported on a shaft 78 which in turn is rotatably supported in the transverse wall 12, said shaft supporting a driver pin 80. A disc cam 82 and a toothed disc 84 are non-rotationally mounted on the shaft 78. The disc cam is provided with a slot 86 which is filled by a resilient lining 88, not shown. The driver pin 80 engages in the said resilient lining. As may be seen by reference to FIG. 1, the toothed disc 84 meshes with the rack 42 but it is provided with a tooth-free section 90 which enables the printing head 14 to be returned under the action of the restoring spring 46. The disc cam 82 co-operates with a positioning lever 92 adapted to support a roller 94 which is strongly thrust by a tension spring 96 into the notches **82*a* of the disc cam 82 and thus locates the disc cam in defined positions. As shown in FIG. 1, the switch 72 is actuated by the positioning lever 92 in such a way that the switch interrupts the circuit of the servomotor 70 whenever the roller 94 drops into one of the notches 82*a* but the switch 72 is closed if the servomotor 70 starts and the disc cam 82 raises the roller 94 and thus pivots the positioning lever 92 against the action of the tension spring 96. The position of the notches 82***a* of the disc cam 82 therefore defines the number and magnitude of the traversing steps of the printing head (column spacing of the time card) to which end it is appropriate to mount the disc cam 82 interchangeably on the shaft 78.

The driver pin 80, the slot 86 and the resilient lining 88 comprise a resilient coupling which can eliminate the run-out travel of the servomotor 70: under the action of the powerful tension spring 96 the disc cam 82 slightly leads the gearwheel 76 if the roller 94 begins to drop into one of the notches 82*a* — this lead is made possible by the resilient lining 88. The positioning lever 92 therefore switches off the servomotor 70 before the gearwheel 76 has reached the location corresponding to the desired position of the disc cam 82. The toothed disc 84 is mounted on the shaft 78 so that the tooth-free section 90 is positioned opposite to the rack 42 when the printing head 14 is in the right-hand position according to FIG. 1; it can then be returned by the restoring spring 46 into the left-hand starting position.

As already mentioned, the indexing lever 34 is provided to index the number wheels 26 to 32 of the printing head 14; details of this will be explained subsequently. The manner in which the indexing lever 34 is actuated will be described first. The illustrated, preferred embodiment of the time recording clock incorporates so-called real-time recording: in order to obtain the actual attendance time simply by subtraction of two numbers the time recording clock according to the invention does not print the actual clock times but a time which does not alter during work intervals despite the advancing time of day. This may be explained by reference to an example: work in a factory which has introduced flexitime cannot begin before 00.70 h; a morning break has been fixed for the time between 09.00 h to 09.15 h, a mid-day break is set to the time between 12.00 h to 13.00 h. The printing head 14 is to be suitable for printing the numbers 0.00 to 12.00. The indexing system for the printing head 14 is selected so that it is set to 0.00 at 07.00 h; it is then indexed together with a master clock so that at the beginning of the morning break it would print the number 2.00. The printing head is not indexed during the morning break, i.e. at 09.15 h it would also print the number 2.00. At the beginning and end of the mid-day break it would print the time 4.75 and in the course of the afternoon and evening the printing head would be indexed in synchronism with the master clock from 4.75 to 11.99 and then to 0.00 whereupon the programme control system interrupts the indexing motion of the printing head until 07.00 h of the next day. In this way it is possible to obtain the actual time worked on that particular day by simple subtraction of the numbers printed into the time card at the commencement and end of work.

Figure 3:
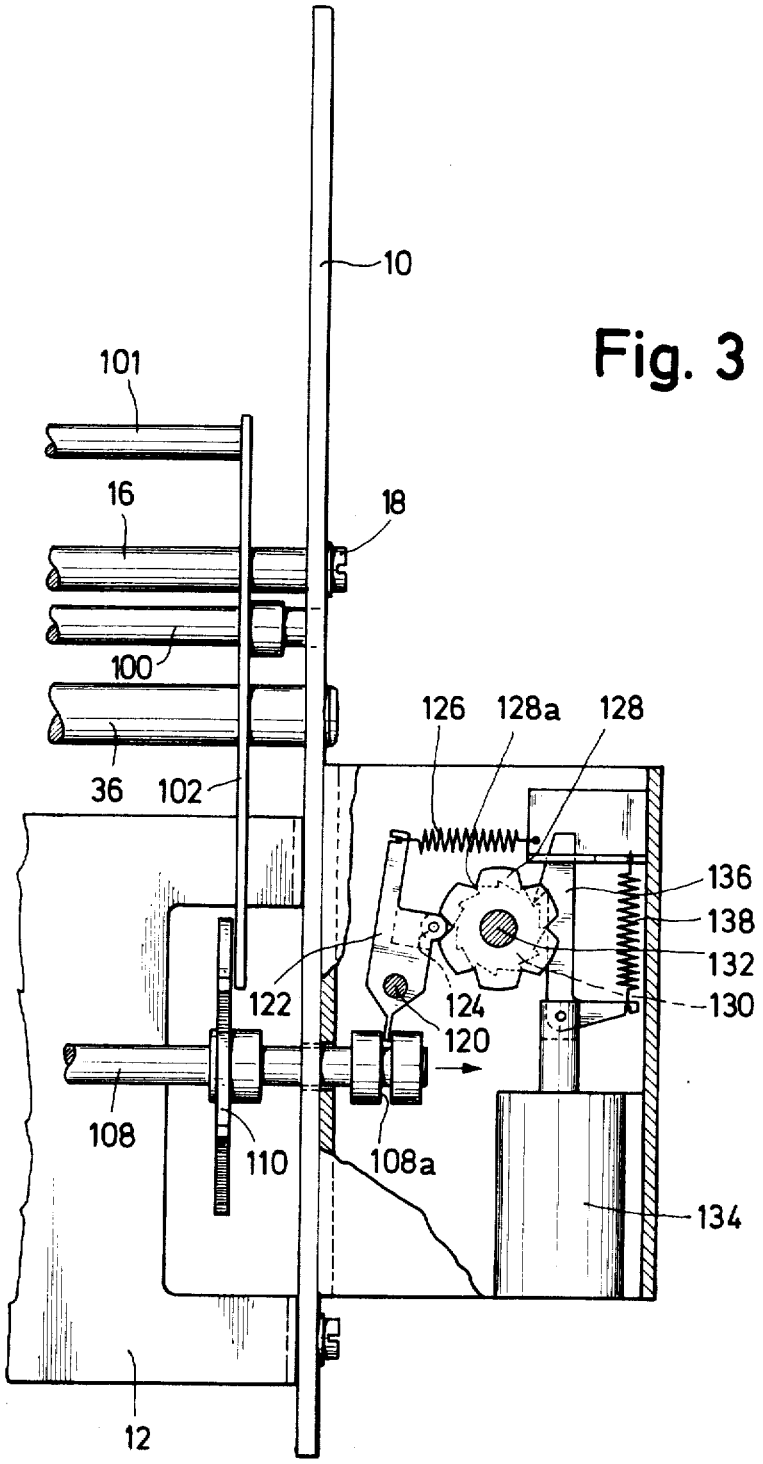
FIG. 3 is a part of the time recording clock to the right of the components shown in FIG. 1.

According to the invention the detailed construction adopted to interrupt the indexing operation of the printing head 14 or of the number wheels 26 to 32 prior to the earliest work commencement and during the fixed work intervals is as follows:

Two pivotable operating levers 102 which are fixedly joined to each other by means of a rod 101 and can be pivoted in the anticlockwise direction against the action of a tension spring 104 are mounted on a rod 100 according to FIG. 2. The rod 101 actuates the indexing lever 34 of the printing head 14 independently of its position along the guide rod 16. A stop abutment 106 is provided on one side wall 10 for one of the two operating levers. An indexing spindle 108 is rotatably supported in the side walls 10; an indexing wheel 110, with six teeth 110*a* in the illustrated preferred embodiment, is mounted on the said spindle. The indexing spindle is driven by a stepping motor or synchronous motor which is not shown but is controlled by the master clock; if a stepping motor is used it will be provided by the master clock with pulses at one minute intervals, each of such pulses causing the indexing spindle 108 to rotate through 60°. If the indexing wheel 110 has six teeth, each pulse of the stepping motor indexes the printing head so that time is recorded in hours and minutes. The removal of teeth of the indexing wheel 110 enables the time display to be altered without the need for effecting any other changes; for example, if the indexing wheel has only one tooth, the printing head will be indexed after every 0.1 h (every 6 minutes) so that a decimal display of the time is obtained. If the indexing wheel is in flush alignment with one of the actuating levers 102, the right lever according to FIGS. 1 and 3, each of the teeth 110*a* will operate the actuating lever so that the printing head is indexed in synchronism with the indexing spindle 108. In order to obtain the previously-described real time recording, the indexing spindle 108 is longitudinally slidable as indicated by the double arrow in FIG. 1. At its right-hand end the spindle is provided with a groove 108*a* (FIG. 3) into which engages an adjusting lever 122 which is pivotable about a spindle 120. The adjusting lever supports a roller 124 which drops under the action of a tension spring 126 into notches 128*a* of a disc cam 128. The disc cam as well as a ratchet wheel 130 is fixedly mounted on a rotatably supported shaft 132. The ratchet wheel is indexed by means of a plunger magnet 134 on which one indexing pawl 136 is hinged. Under the action of a tension spring 138 the said indexing pawl engages with the ratchet wheel 130. The plunger magnet 134 is controlled by the programme control system of the time recording clock in which the earliest work commencement, work intervals and the latest work termination is stored, the said magnet being adapted to index the ratchet wheel 130 by one tooth whenever the printing head 14 is to be coupled to the indexing spindle 108 or is to be disengaged therefrom. If the roller 124 of the adjusting lever 122 has dropped into one of the notches 128*a* of the disc cam 128 in a particular position of the ratchet wheel 130 and if this causes the indexing spindle 108 to be moved to the left by the adjusting lever 122 under the action of the tension spring 126, then any indexing of the ratchet wheel causes the roller 124 of the adjusting lever 122 to remain stationary on one of the cams of the disc cam 128 so that the indexing spindle 108 is moved to the right. With the next operation of the plunger magnet 134 the indexing spindle 108 is then again moved to the left since the roller 124 drops into the next notch 128*a* of the disc cam. The indexing wheel 110 and the operating lever 102 are disengaged when the indexing spindle 108 is in the left-hand limiting position as indicated in FIGS. 1 and 3, but when the indexing spindle 108 is in the right-hand limiting position one operating lever will engage between the teeth 110*a* of the indexing wheel. The sliding motion of the indexing spindle 108 does not of course interrupt its drive. The construction of the printing head will now be described in detail.

Figure 4:
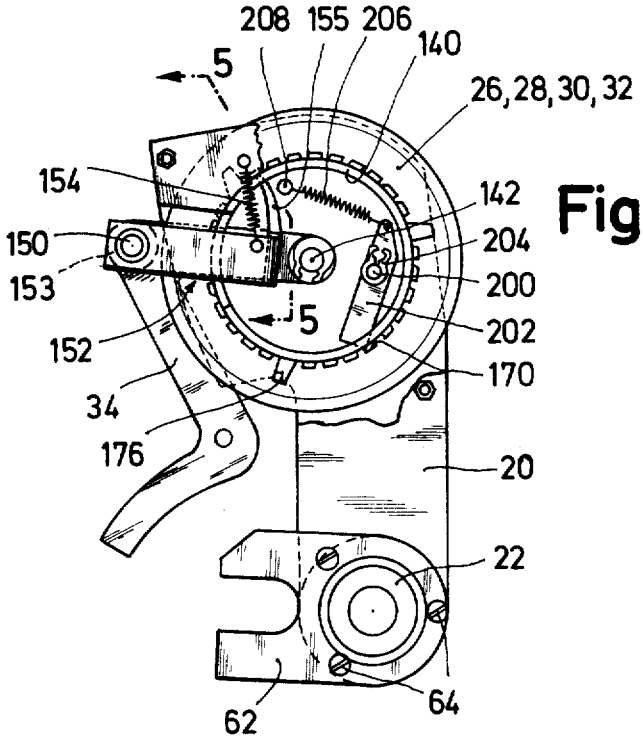
FIG. 4 is a side view of the printing head of the time recording clock in the direction of the arrow A shown in FIG. 1.
Figure 5:
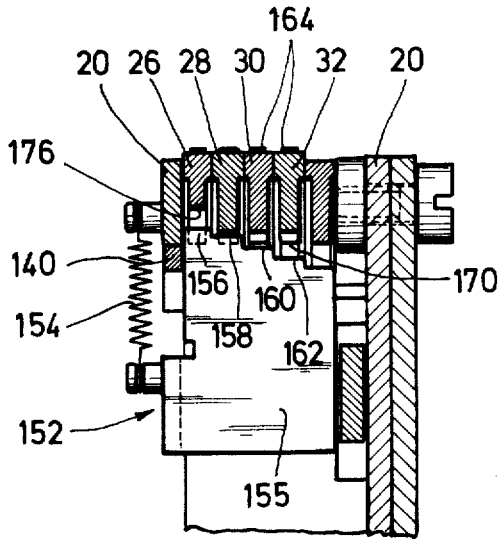
FIG. 5 is a section through a part of the printing head taken along the line 5—5 of FIG. 4.
Figure 6:
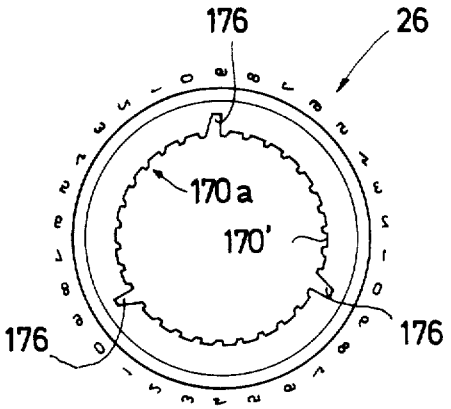
FIGS. 6 to FIG. 9 are side views of the four number wheels of the printing head, namely the first and second minute wheel and the first and second hour wheel.
Figure 7:
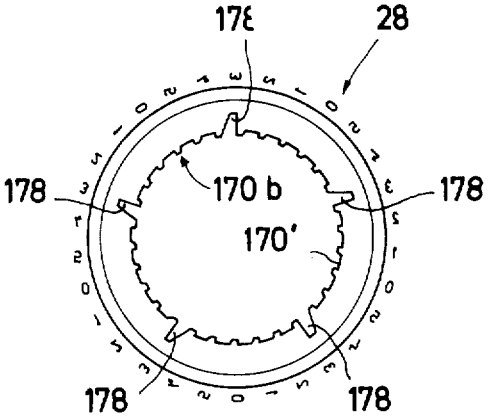
Figure 8:
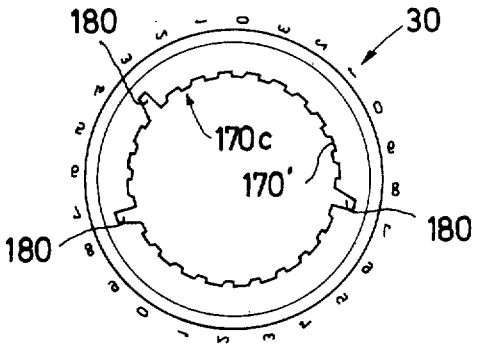
Figure 9:
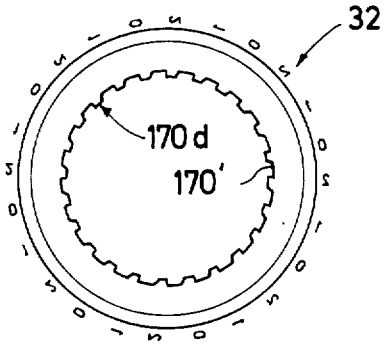

A bearing cylinder 140 on which the annular number wheels 26 to 32 are rotatably supported is mounted on the printing head side member 20 which is on the left according to FIG. 1. A central fixed shaft 142 of the printing head is situated in the centre of the bearing cylinder, the indexing lever 34 pivoting about the said axis and engaging by means of an arm not shown between the left side member 20 and the number wheel 32 and extending as far as the shaft 142. As may be seen more particularly by reference to FIG. 2, the indexing lever 34 is biased by the action of a return spring 144 the upper end of which acts on the left-hand side member 20 and draws the indexing lever 34 by means of a stud 146 against a stop abutment 148 which defines the starting position of the indexing lever. As may be seen by reference to FIGS. 1 and 4, a stud 150 on which an indexing pawl, designated in its entirety by the numeral 152, is rotatably supported by means of a bush mounted on the pawl, is also secured to the indexing lever 34. The indexing pawl is biased by the action of a tension spring 154 whose fixed end acts on the right-hand side member 20 of the printing head 14. As indicated by FIG. 5, one arm 155 of the indexing pawl engages in the interior of the bearing cylinder 140 and this arm supports four trip dogs 156 to 162 of different length, each of which is associated with one of the four number wheels 26 to 32. FIGS. 2 to 5 clearly reveal the printing types 164 which are mounted on the circumference of the number wheels.

FIS. 6 to 9 show the four number wheels 26 to 32 in detail; if the printing head is to display the time of day in minutes and hours the number wheel 26 will represent the first minute wheel, the number wheel 28 the second minute wheel, the number wheel 30 the first hour wheel and finally the number wheel 32 the second hour wheel. In the illustrated embodiment the first minute wheel supports three sets of number sequences 0–9; the number wheels 28 to 32 of the same diameter support the following printing types; the second minute wheel 28 supports five sets of number sequences 0–5, the first hour wheel supports two sets of number sequences 0–9 and one set of number sequences 0–3 and the second hour wheel 32 supports eight sets of number sequences 0–2. Accordingly, the preferred embodiment of the annular number wheels 26–32 contains different internal tooth systems **170*a*–170*d* the tooth shapes of which are so selected as to produce centring surfaces 170'. Despite the different number of teeth (30 or 24) of the internal tooth systems 170*a*–170*d* of the same diameter, it is possible to operate with a single indexing pawl 152 if its length of stroke is made as long as the maximum tooth gap (the maximum tooth gap must of course be less than twice the minimum tooth gap). The inner edges of the annular number wheels also act as sliding blocks for the indexing pawl 152 and to this end the first minute wheel 26 is provided with three cut-outs 176, the second minute wheel 28 with five cut-outs 178 and the first hour wheel 30 with three cut-outs 180, while the second hour wheel which is the last number wheel has no cut-out. Due to the action of the tension spring 154 the longest trip dog 156 of the indexing pawl 152 always engages with the internal teeth 170 of the first minute wheel 26. The trip dogs 158 to 162 however are so short that they cannot engage with the internal tooth system 170 of the number wheels 28 to 32 for as long as the trip dog 156 is unable to drop into one of the cut-outs 176 of the first minute wheel. With respect to the printing types the cut-outs 176 of the first minute wheel are arranged so that the longest trip dog 156 is situated adjacent to one of the cut-outs 176 when one of the numbers 9 of the first minute wheel is situated opposite to the time card 43. If the indexing lever 34 according to FIG. 2 moves in the clockwise direction for indexing the printing head the longest trip dog 156 will drop into the said cut-out 176 by the action of the tension spring 154, i.e. the trip dog 156 engages more deeply into the internal tooth system 170 of the first minute wheel than would be the case when indexing two other numbers so that the next shorter adjacent trip dog 158 is able to engage in the internal tooth system 170*d* of the second minute wheel 28. While the first minute wheel is indexed from the numeral 9 to the numeral 0 the second minute wheel is simultaneously indexed by one numeral. If the second longest trip dog 158 is situated in front of one of the cut-outs 178 of the second minute wheel 28, this being always the case when the second minute wheel is to be indexed from the numeral 5 to the numeral 0, the indexing pawl 152 is able to drop more deeply due to the action of the tension spring 154 when the indexing lever 34 operates since not only the trip dog 156 drops into one of the cut-outs 176 but the trip dog 158 drops into one of the cut-outs 178. As a consequence, the next shorter trip dog 160 is able to drop into the internal tooth system 170*c* of the first hour wheel. The second hour wheel 32 will finally be also entrained if the configuration of the three number wheels 26–30 is such that the trip dogs 156, 158 and 160 are able to drop into the cut-outs 176, 178 and 180. It should be noted that the operating motion of the indexing lever 34 takes place due to the action of the indexing wheel 110 while the restoring spring 144** is responsible for the actual indexing motion of the number wheels 26–32.

Figure 10:
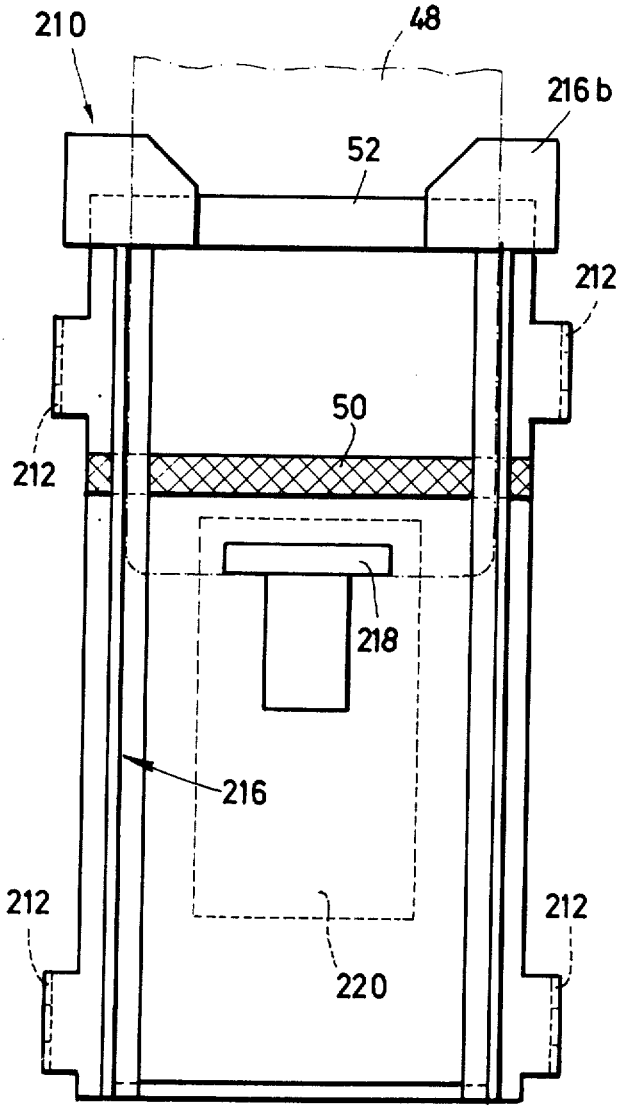
FIG. 10 is a view of the rear wall of the time recording clock casing as seen from the interior thereof.
Figure 11:
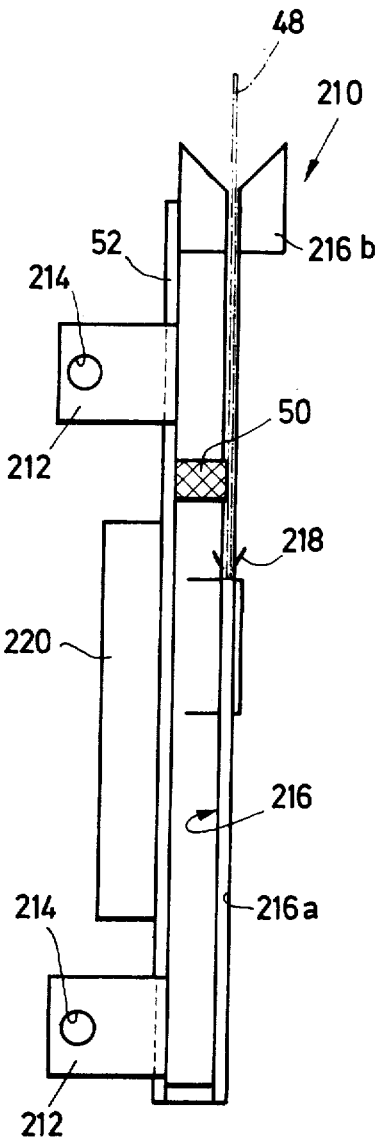
FIG. 11 is a side view of the rear wall.

FIGS. 10 and 11 show purely in diagrammatic form the rear wall of a time recording clock according to the invention, this rear wall being associated with a casing not shown and being referenced in its entirety with the numeral 210. The previously-mentioned plate 52 which supports the rubber strip 50 forms the actual wall and is provided with bent lugs 212 each of which is provided with an aperture 214. The said rear wall 210 can be mounted by means of the said apertures and transversely extending rods on side walls of the casing, not shown, or on frame side walls of the time recording clock, namely in an easily interchangeable manner.

Two guide rails **216*a* of U-shaped cross-section are mounted on the inside of the plate 52 and together with two guides sections 216*b* comprise retaining means 216 for the time card 48; the plate 52 also supports a stop abutment 218 which is vertically slidably and is guided in the guide rails 216*a* for the bottom edge of the time card and an indexing device 220, shown only diagrammatically, which defines the position of the stop abutment 218** during a printing operation.

The kind and construction of the indexing device depends on the subdivision of the time cards employed in the system; however, it is not necessary to explain the construction of different indexing devices because such construction is known. For example, if the IN/OUT times are printed one below the other in the columns of the time cards, the indexing device 220 used to this end will lock the stop abutment 218, resiliently biased in the upward direction by a spring not shown, in a position which is higher by one line spacing than the position at which the appropriate card was last stamped. To this end, the indexing device 220 is provided in known manner with an optical scanning device adapted to scan the printed images on the time card. However, when using time cards whose lines are associated with different days the stop abutment 218 is set by an indexing device 220 which is controlled by the programs control system of the time recording clock and the stop abutment will then be moved by one line spacing once every day.

It is sufficient to stock rear walls 210 with the different indexing devices 220 because every time recording clock can be adapted to the required time cards by fitting the appropriate rear wall.

The left-hand side member 20 of the printing head is provided with a trunnion 200 on which a plurality of pawls 202 are pivotably supported at distances from each other to ensure that one of the pawls engages into each internal tooth system 170 of the number wheels 26 to 32. The said pawls are secured on the trunnion by means of a circlip 204. Each of the pawls is also biased by a tension spring 206 one end of which acts on a pin 208 which is mounted on the left-hand side member 20. Since the number wheels according to FIG. 4 are indexed in the clockwise direction the pawls 202 will prevent reverse rotation of the number wheels when the indexing pawl operates in the anticlockwise direction but they do not obstruct the indexing motion of the number wheels.

It should be noted that the bearing cylinder 140 is provided with cut-outs through which the trip dogs 156 to 162 and the pawls 202 are able to engage in the internal tooth system 170.

The actuating lever 102 instead of the indexing spindle 108 could be displaced to obtain real time recording. In general terms and in accordance with the invention, the indexing arm which is constructed as the tooth 110*a* and the element co-operating therewith are displaced relative to each other.

We claim:

1. In an in-and-out time recorder the combination comprising a printing device for printing clock times along the lines of a data medium; retaining means for holding the data medium adjacent the printing device; said printing device being slidably mounted for displacement substantially parallel to the lines of the data medium; said printing device comprising a plurality of adjacent number wheels provided with number print types for imprinting clock times onto the data medium; indexing means connected to said number wheels for indexing said number wheels; an electric motor for effecting displacement of the printing device relative to the retaining means; drive means coupling said electric motor to said printing device, and including a resilient coupling switch means for switching said electric motor on and off at the beginning and approximately at the end respectively of each displacement of said printing device, and positioning means positively coupled with the printing device in at least one direction of displacement of said printing device for positioning the same in predetermined positions relative to a line of the data medium.

2. A time recorder as claimed in claim 1, wherein said positioning means comprises a recessed positioning element positively coupled with the printing device in at least one direction of displacement; such recesses corresponding with said predetermined positions and being engaged by a ratchet element which is urged into engagement therein when the printing device reaches one of its predetermined positions.

3. In a timer recorder as claimed in claim 1, wherein said resilient coupling drives the positioning element positively coupled with the printing device.

4. In a time recorder as claimed in claim 2, wherein said switch means for said motor is actuated by said ratchet element into the off position.

5. In a time recorder as claimed in claim 1, wherein said indexing means comprises a lever, and an indexing arm for actuating said lever is rotatably mounted on an indexing spindle and shiftable along said spindle axis between a first and a second position in which the indexing spindle and said lever are coupled and uncoupled, respectively.

6. In a time recorder as claimed in claim 5, wherein a disc cam indexed in steps by half the cam width and a cam follower are operatively connected to and shift said indexing spindle.

7. In a time recorder as claimed in claim 6, wherein the cam follower comprises a second lever pivotally mounted for movement about an axis extending transversely to the indexing spindle and engages a groove disposed in said indexing spindle.

8. In a time recorder as claimed in claim 5, wherein said indexing means comprises an indexing rod extending parallel to and is movable generally transversely to the sliding direction of the printing device, in response to a pivotal movement of said lever; and means on said printing device responsive to a movement of the indexing rod for indexing the number wheel.

9. In a time recorder as claimed in claim 1, with a rear wall carrying said retaining means and a stop abutment for the data medium, which stop abutment is slidable along the vertical axis of said retaining means; said rear wall being detachably held on said recorder.

10. In a time recorder as claimed in claim 9, wherein said rear wall is provided with a resilient support for the data medium during the printing operation; said support being arranged opposite the printing device.

11. In an in-and-out time recorder the combination comprising a printing device for printing clock times along the lines of a data medium; retaining means for holding the data medium adjacent the printing device; said printing device being slidably mounted for displacement substantially parallel to the lines of the data medium; said printing device comprising a plurality of adjacent number wheels provided with number print types for imprinting clock times onto the data medium; indexing means for indexing said number wheels; said indexing means comprising first and second movable supports extending generally parallel to the sliding direction of the printing device; a first indexing arm mounted on a first one of said supports for movement therewith; a second indexing arm mounted on a second one of said supports for movement with the second support; said second indexing arm being engageable with and movable by said first indexing arm; said second support being operatively connected to said number wheels for indexing the number wheels during movement of said second support, and means for altering the relative disposition between said indexing arm along an axis parallel to said supports between a first and a second position in which the first and second indexing arms are engaged and disengaged respectively.

12. The time recorder as claimed in claim 11, wherein the altering means comprise a disc cam and a cam follower which are operatively connected to and shift one of said indexing arms.

13. The time recorder as claimed in claim 12, wherein the cam follower comprises a second lever pivotally mounted for movement about an axis extending transversely to the shifting direction of said indexing arm to be shifted and engages a grooved element rotating with the indexing arm to be shifted.

14. In a time recorder as claimed in claim 11, with a rear wall carrying said retaining means and a stop abutment for the data medium, which stop abutment is slidable along the vertical axis of said retaining means; said rear wall being detachably held on said recorder.

15. In a time recorder as claimed in claim 14, wherein said rear wall is provided with a resilient support for the data medium during the printing operation; said support being arranged opposite the printing device.

* * * * *